US007721826B2

(12) United States Patent
Hall et al.

(10) Patent No.: US 7,721,826 B2
(45) Date of Patent: May 25, 2010

(54) DOWNHOLE JACK ASSEMBLY SENSOR

(75) Inventors: David R. Hall, Provo, UT (US); David Lundgreen, Provo, UT (US); Jim Shumway, Lehi, UT (US); Nathan Nelson, Provo, UT (US); Daryl Wise, Provo, UT (US); Paula Turner, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 229 days.

(21) Appl. No.: 11/851,094

(22) Filed: Sep. 6, 2007

(65) Prior Publication Data

US 2009/0065251 A1 Mar. 12, 2009

(51) Int. Cl.
*E21B 7/10* (2006.01)
*E21B 10/26* (2006.01)

(52) U.S. Cl. ..... 175/74; 175/322; 175/385

(58) Field of Classification Search ..... 175/408, 175/415, 95, 107, 333, 73, 74, 322, 385
See application file for complete search history.

(56) References Cited

U.S. PATENT DOCUMENTS

| | | | | |
|---|---|---|---|---|
| 465,103 | A | | 12/1891 | Wagner |
| 616,118 | A | | 12/1898 | Kunhe |
| 946,060 | A | | 1/1910 | Looker |
| 1,116,154 | A | | 11/1914 | Stowers |
| 1,183,630 | A | | 5/1916 | Bryson |
| 1,189,560 | A | | 7/1916 | Gondos |
| 1,360,908 | A | | 11/1920 | Everson |
| 1,387,733 | A | | 8/1921 | Midgett |
| 1,460,671 | A | | 7/1923 | Habsacker |
| 1,544,757 | A | | 7/1925 | Hufford |
| 1,821,474 | A | | 9/1931 | Meroer |
| 1,879,177 | A | | 9/1932 | Gault |
| 2,054,255 | A | | 9/1936 | Howard |
| 2,064,255 | A | | 12/1936 | Garfield |
| 2,169,223 | A | | 8/1939 | Christian |
| 2,216,130 | A | | 10/1940 | Court |
| 2,227,233 | A | * | 12/1940 | Noble et al. ..... 175/80 |
| 2,320,136 | A | | 5/1943 | Kammerer |
| 2,466,991 | A | | 4/1949 | Kammerer |
| 2,540,464 | A | | 2/1951 | Stokes |
| 2,544,036 | A | | 3/1951 | Kammerer |
| 2,755,071 | A | | 7/1956 | Kammerer |
| 2,776,819 | A | | 1/1957 | Brown |
| 2,819,043 | A | | 1/1958 | Henderson |
| 2,838,284 | A | | 6/1958 | Austin |
| 2,894,722 | A | | 7/1959 | Buttolph |
| 2,901,223 | A | | 8/1959 | Scott |
| 2,963,102 | A | | 12/1960 | Smith |

(Continued)

*Primary Examiner*—David J. Bagnell
*Assistant Examiner*—Kipp C Wallace
(74) *Attorney, Agent, or Firm*—Holme Roberts & Owen LLP

(57) ABSTRACT

In one aspect of the invention, a drill string comprises a drill bit with a body intermediate a shank and a working face, and the working face comprises at least one cutting element. A jack assembly is disposed within the drill bit body and comprises a jack element disposed on a distal end of the assembly. The jack element substantially protrudes from the working face and is adapted to move with respect to the bit body. At least one position feedback sensor is disposed proximate the jack assembly and is adapted to detect a position and/or orientation of the jack element.

17 Claims, 11 Drawing Sheets

U.S. PATENT DOCUMENTS 3,135,341 A 6/1964 Ritter
3,294,188 A 12/1966 Buell
3,301,339 A 1/1967 Pennebaker, Jr.
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,163,520 A * 11/1992 Gibson et al. ..... 175/19
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,466,513 B1 * 10/2002 Pabon et al. ..... 367/35
6,474,425 B1 11/2002 Truax
8,484,825 11/2002 Watson
6,510,906 B1 1/2003 Richert
6,513,606 B1 2/2003 Krueger
6,533,050 B2 3/2003 McCoy
6,575,236 B1 * 6/2003 Heijnen ..... 166/66.4
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
9,629,076 4/2005 Fenuel
6,913,095 B2 * 7/2005 Krueger ..... 175/76
6,953,096 B2 10/2005 Gledhill
7,270,196 B2 * 9/2007 Hall ..... 175/57
7,360,610 B2 * 4/2008 Hall et al. ..... 175/61
2003/0213621 A1 11/2003 Britten
2004/0238221 A1 12/2004 Runia
2004/0256155 A1 12/2004 Kriesels
2007/0079988 A1 * 4/2007 Konschuh et al. ..... 175/40
2007/0114066 A1 * 5/2007 Hall et al. ..... 175/61
2007/0221408 A1 * 9/2007 Hall et al. ..... 175/57
2007/0221417 A1 * 9/2007 Hall et al. ..... 175/415
2008/0179098 A1 * 7/2008 Hall et al. ..... 175/73

* cited by examiner

DOWNHOLE JACK ASSEMBLY SENSOR

BACKGROUND OF THE INVENTION

The present invention relates to the field of downhole oil, gas, and/or geothermal exploration and more particularly to the field of drill bits for aiding such exploration and drilling.

Drill bits use rotary energy provided by the tool string to cut through downhole formations, thus advancing the tool string further into the ground. To use drilling time effectively, sensors have been placed in the drill string, usually in the tool string, to assist the operator in making drilling decisions. In the patent prior art, equipment and methods of conveying and interpreting sensory data obtained from downhole have been disclosed.

For example, U.S. Pat. No. 6,150,822 to Hong, et al., which is herein incorporated by reference for all that it contains, discloses a microwave frequency range sensor (antenna or wave guide) disposed in the face of a diamond or PDC drill bit configured to minimize invasion of drilling fluid into the formation ahead of the bit. The sensor is connected to an instrument disposed in a sub interposed in the drill stem for generating and measuring the alteration of microwave energy.

U.S. Pat. No. 6,814,162 to Moran, et al., which is herein incorporated by reference for all that it contains, discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the drill string.

U.S. Pat. No. 5,415,030 to Jogi, et al., which is herein incorporated by reference for all that it contains, discloses a method for evaluating formations and bit conditions. The invention processes signals indicative of downhole weight on bit (WOB), downhole torque (TOR), rate of penetration (ROP), and bit rotations (RPM), while taking into account bit geometry to provide a plurality of well logs and to optimize the drilling process.

U.S. Pat. No. 5,363,926 to Mizuno, which is herein incorporated by reference for all that it contains, discloses a device for detecting inclination of a boring head of a boring tool.

The prior art also discloses devices adapted to steer the direction of penetration of a drill string. U.S. Pat. Nos. 6,913,095 to Krueger, 6,092,610 to Kosmala, et al., 6,581,699 to Chen, et al., 2,498,192 to Wright, 6,749,031 to Klemm, 7,013,994 to Eddison, which are all herein incorporated by reference for all that they contain, discloses directional drilling systems.

BRIEF SUMMARY OF THE INVENTION

In one aspect of the invention, a drill string comprises a drill bit with a body intermediate a shank and a working face, and the working face comprises at least one cutting element. A jack assembly is disposed within the drill bit body and comprises a jack element disposed on a distal end of the assembly. The jack element substantially protrudes from the working face and is adapted to move with respect to the bit body. At least one position feedback sensor is disposed proximate the jack assembly and is adapted to detect a position and/or orientation of the jack element. The position feedback sensor may be adapted to calculate a velocity of the jack element.

The jack element may be adapted to rotate about a central axis and it may be adapted to translate along the central axis.

Movement of the jack element may be powered by a downhole motor. The jack element may comprise a distal deflecting surface having an angle relative to the central axis of 15 to 75 degrees. The jack assembly may comprise a driving shaft disposed intermediate a driving mechanism and the jack element. In some embodiments a geartrain may be disposed intermediate the driving mechanism and the driving shaft in the jack assembly. A position feedback sensor may be disposed within the geartrain, and it may be disposed proximate other components of the jack assembly.

The position feedback sensor may be in electrical communication with a downhole network. The feedback sensor may be powered by a downhole power source and may be part of a bottom hole assembly. The drill string may comprise a plurality of position feedback sensors. Position feedback sensors or a plurality thereof may comprise a hall-effect sensor, an optical encoder, a magnet, a mechanical switch, a slide switch, a resolver, an accelerometer, or combinations thereof. Position feedback sensors may sense the position and/or orientation of the jack element by recognizing a characteristic of a signal element disposed proximate the sensor. The characteristic may comprise a change in density, geometry, length, chemical composition, magnetism, conductivity, optical reactivity, opacity, reflectivity, surface coating composition, or combinations thereof. The signal element may be a sprocket that is disposed on the jack assembly and is mechanically coupled to the jack element.

The drill string may comprise at least one electrical component selected from the group consisting of direction and inclination packages, generators, motors, steering boards, and combinations thereof. The at bast one electrical component may be rotationally fixed to the drill string. In some embodiments at least one electrical component may rotationally coupled with respect to the jack element.

DETAILED DESCRIPTION OF THE INVENTION AND THE PREFERRED EMBODIMENT

Figure 1:
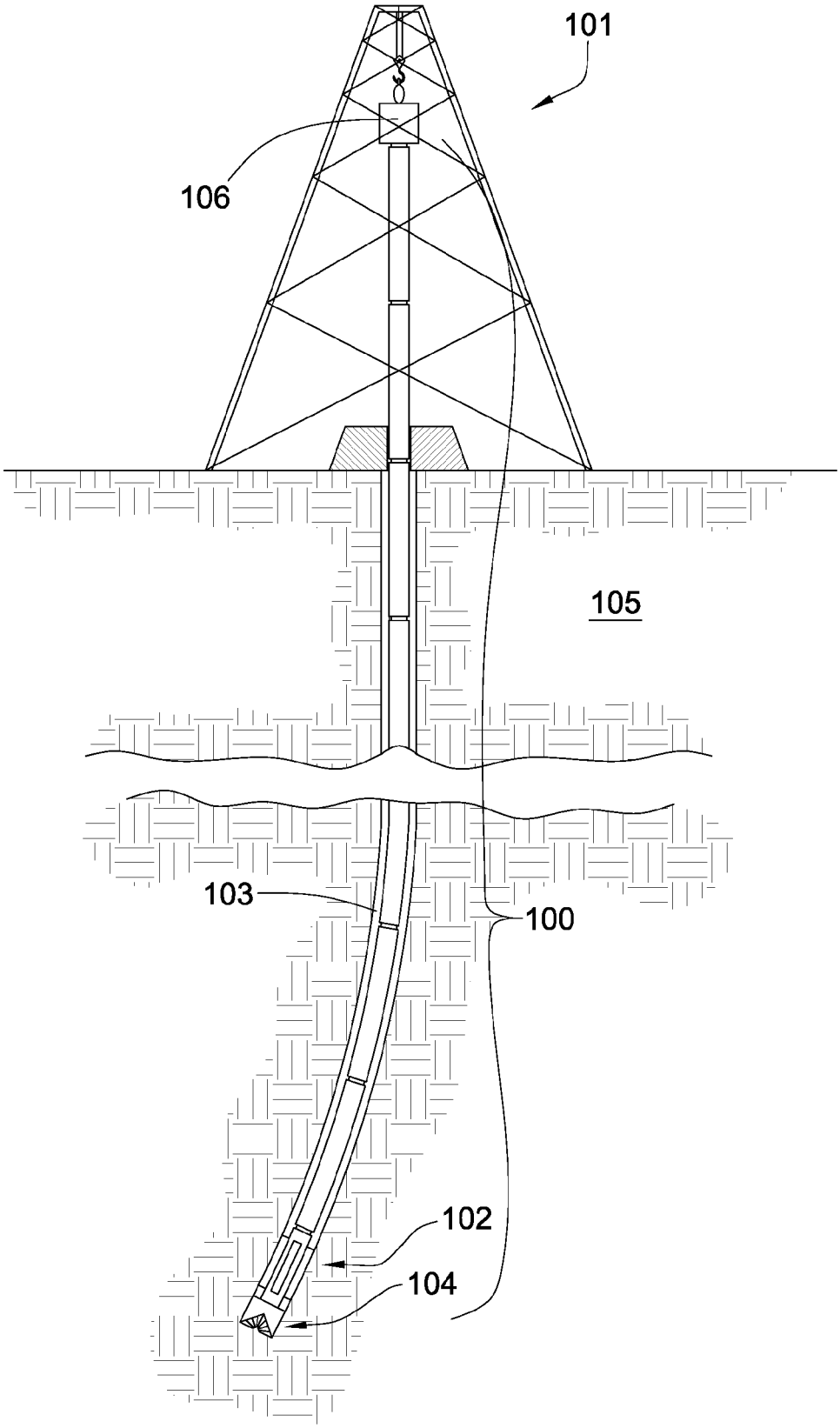
FIG. 1 is an orthogonal diagram of an embodiment of drill string suspended in a wellbore.

FIG. 1 is a perspective diagram of an embodiment of a drill string 100 suspended by a derrick 101. A bottom hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may be adapted to steer the drill string 100 in a desired trajectory. Steering may be controlled by rotating a jack element (see FIG. 2) that is disposed at least partially within the drill bit 104 around a central axis of the jack element. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
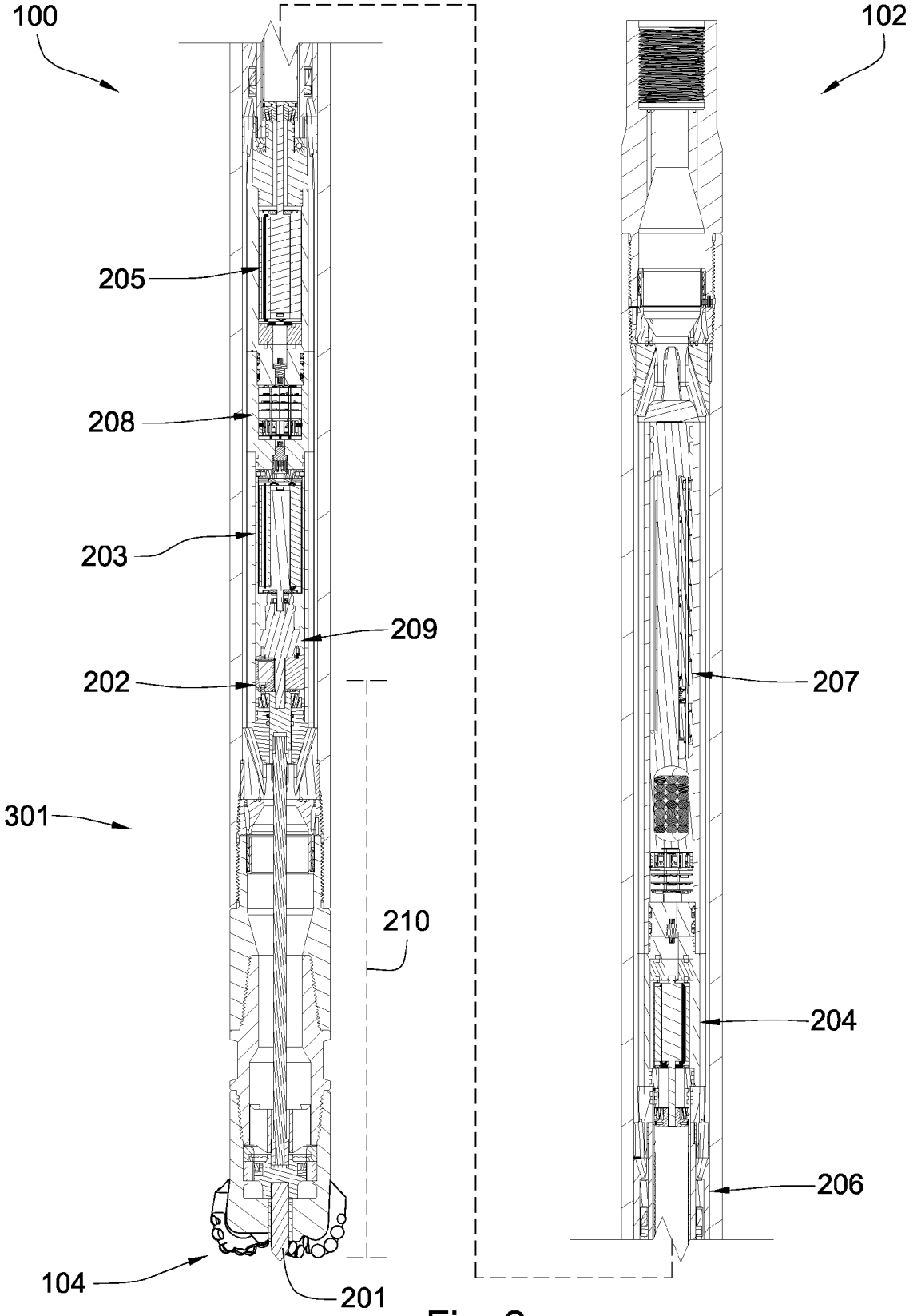
FIG. 2 is a cross-sectional diagram of an embodiment of a drill string.

Referring now to FIG. 2, a cross-sectional diagram of drill string 100 discloses a bottom hole assembly (BHA) 102. The drill bit 104 may be part of the BHA 102 and comprises a jack element 201. The jack element 201 may oscillate towards and away from the formation 105 and/or the jack element 201 may rotate around an axis. The drill string comprises at least one position feedback sensor 202 that is adapted to detect a position and/or orientation of the jack element 201. Monitoring the position and/or orientation of the jack element 201 may aid in steering the drill string 100. Rotation of the jack element 201 may be powered by a driving mechanism, such as a downhole motor 203. The downhole motor 203 may be an electric motor, a mud motor, or combinations thereof. In the present embodiment, drill string 100 comprises an upper generator 204 and a lower generator 205. Both generators 204, 205 are powered by the flow of drilling mud (not shown) past one or more turbines 206 disposed intermediate the two generators 204, 205. In some embodiments only one generator may be used, or another method of powering the motor 203 may be employed.

The upper generator 204 may provide electricity to a direction and inclination (D&I) package 207. D&I package 207 may monitor the orientation of the BHA 102 with respect to some relatively constant object, such as the center of the planet, the moon, the surface of the planet, a satellite, or combinations thereof. The lower generator 205 may provide electrical power to a computational board 208 and to the motor 203. The computational board 208 may control steering and/or motor functions. The computational board 208 may receive drill string orientation information from the D&I package 207 and may alter the speed or direction of the motor 203.

In the present embodiment a jack assembly 301 is disposed in a terminal region 210 of the drill string 100 and may be adapted to rotate with respect to the drill string 100 while the motor 203 may be rotationally fixed to the drill string 100. In some embodiments one or more motor 203, generator 204, 205, computational board 208, D&I package 207, or some other electrical component, may be rotationally isolated from the drill string 100. In the present embodiment the motor 203 connects to the jack element 201 via a geartrain 209. The geartrain 209 may couple rotation of the motor 203 to rotation of the jack element 201 at a ratio of 25 rotations to 1 rotation and may itself rotationally fixed to the drill string 100. In some embodiments a different ratio may be used. The geartrain 209 and the jack element 201 may be part of the jack assembly 301.

Figure 3:
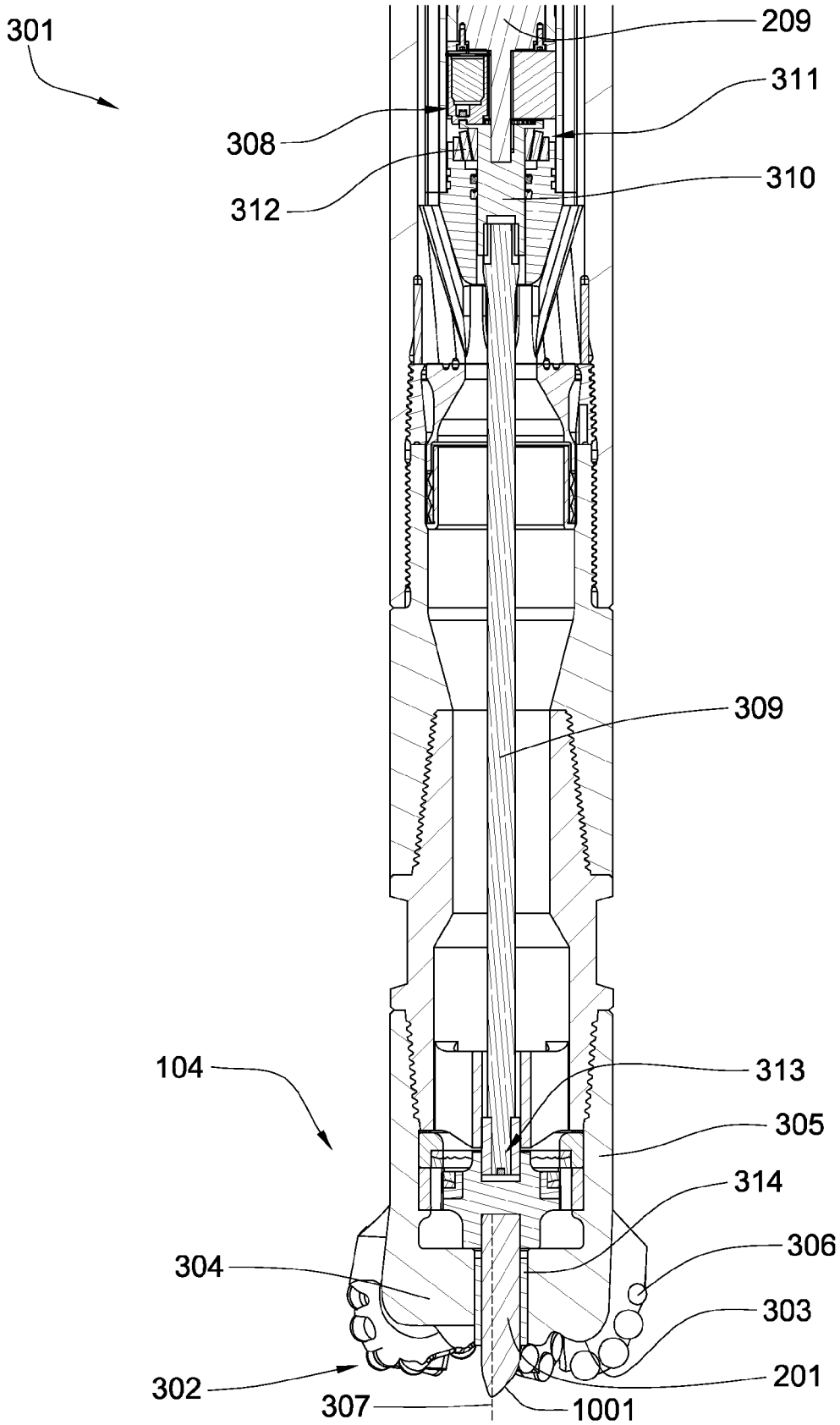
FIG. 3 is a cross-sectional diagram of an embodiment of a jack assembly.

FIG. 3 discloses a cross-sectional diagram of an embodiment of a jack assembly 301. The jack assembly 301 is disposed within the drill string 100 and may be disposed with the BHA 102. The jack element 201 is disposed on a distal end 302 of jack assembly 301, substantially protrudes from a working face 303 of the drill bit 104, and is adapted to move with respect to a body 304 of the bit 104. The bit body 304 is disposed intermediate a shank 305 and the working face 303. The working face 303 comprises at least one cutting element 306. In the present embodiment the working face comprises a plurality of cutting elements 306. The drill bit 104 may advance the drill string 100 further into the formation 105 by rotating, thereby allowing the cutting elements 306 to dig into and degrade the formation 105. The jack element 201 may assist in advancing the drill string 100 further into the formation 105 by oscillating back and forth with respect to the formation 105.

In the present embodiment the jack element 201 comprises a primary deflecting surface 1001 disposed on a distal end of the jack element 201. The deflecting surface 1001 may form an angle relative to a central axis 307 of the jack element 201 of 15 to 75 degrees. The angle may create a directional bias in the jack element 201. The deflecting surface 1001 of the jack element 201 may cause the drill bit 104 to drill substantially in a direction indicated by the directional bias of the jack element 201. By controlling the orientation of the deflecting surface 1001 in relation to the drill bit 104 or to some fixed object the direction of drilling may be controlled. In some drilling applications, the drill bit, when desired, may drill 6 to 20 degrees per 100 feet drilled. In some embodiments, the jack element 201 may be used to steer the drill string 104 in a straight trajectory if the formation 105 comprises characteristics that tend to steer the drill string 104 in an opposing direction.

The primary deflecting surface 1001 may comprise a surface area of 0.5 to 4 square inches. The primary surface 1001 may have a radius of curvature of 0.75 to 1.25 inches. The jack element 201 may have a diameter of 0.5 to 1 inch, and may comprise carbide. The distal end of the jack element 201 may have rounded edges so that stresses exerted on the distal end may be efficiently distributed rather than being concentrated on corners and edges.

The jack element 201 may be supported by a bushing 314 and/or bearing and may be in communication with at least one bearing. The bushing 314 may be placed between the jack element 201 and the drill string 100 in order to allow for low-friction rotation of the jack element 201 with respect to the drill string 100. The bushing 314 may be beneficial in allowing the jack element 201 to be rotationally isolated from the drill string 100. Thus, during a drilling operation, the jack element 201 may steer the drill string 100 as the drill string 100 rotates around the jack element 201. The jack element 201 may be driven by the motor 203 to rotate in a direction opposite the drill string 100.

In the present embodiment two position feedback sensors 202 are disposed proximate the jack assembly 301. A first sensor 308 is disposed proximate a coupler 310 on a geartrain side 311 of the coupler 310. A driving shaft 309 may rotationally couple the jack element 201 to the coupler 310 and may be disposed intermediate the motor 203 and the jack element 201. The coupler 310 may connect the geartrain 209 that is disposed intermediate the motor 203 and the driving shaft 309 to the driving shaft 309. A bearing 312 facilitates rotation of the coupler 310 with respect to the drill string 100. A second sensor 313 may be disposed proximate the jack element 201 in the driving shaft 309. Both the first sensor 308 and the second sensor 313 may be embodiments of position feedback sensors 202. In some embodiments a plurality of position feedback sensors 202 disposed proximate the jack assembly 301 may all be first sensors 308, or they may all be second sensors 313. In other embodiments a drill string 100 may comprise no more than one position feedback sensor 202.

Figure 4:
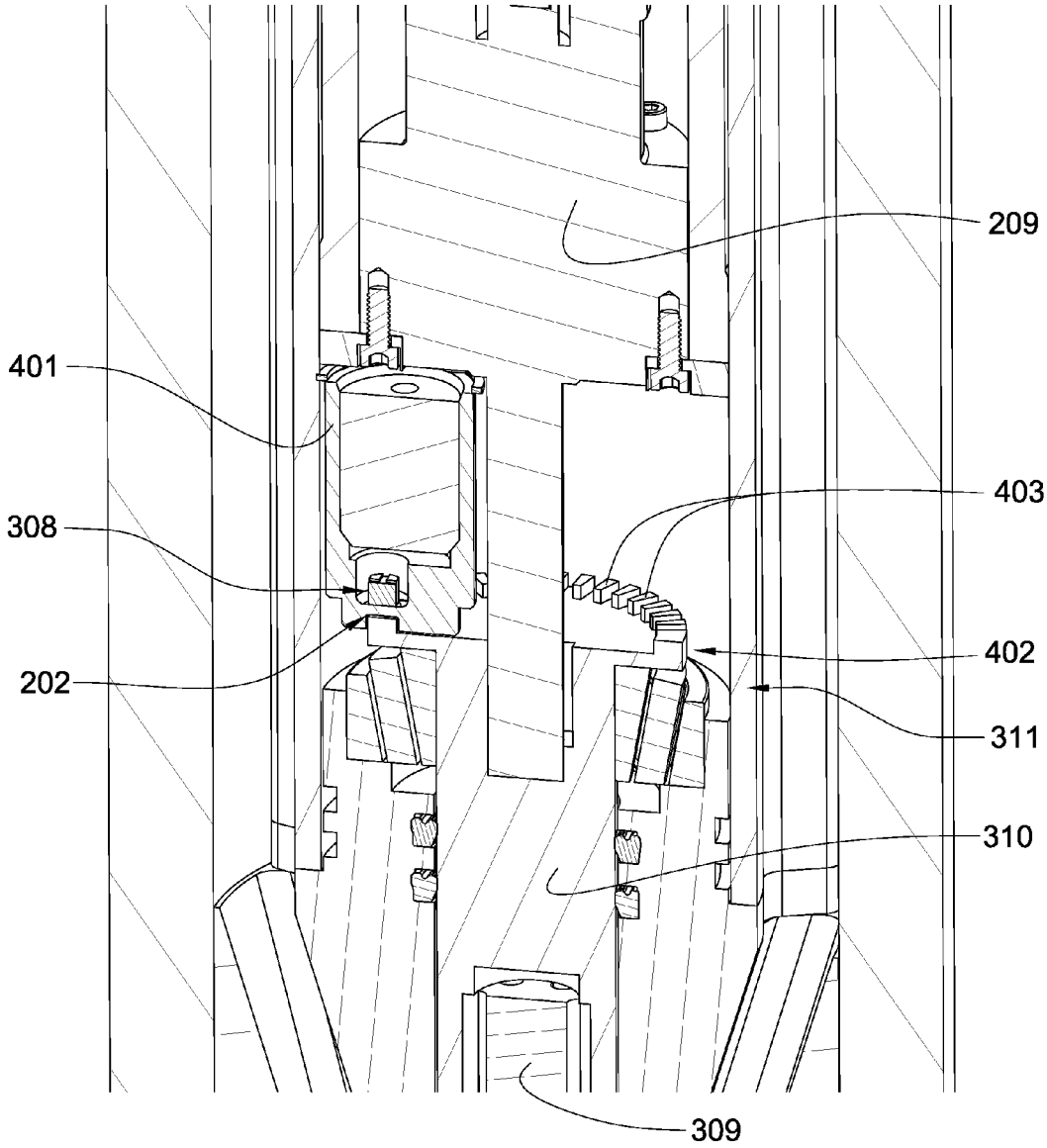
FIG. 4 is a cross-sectional diagram of an embodiment of a portion of a jack assembly.

FIG. 4 discloses a closer cross-sectional view of an embodiment of a first position feedback sensor 308. The first sensor 308 is disposed within a pressure vessel 401 that is located proximate the geartrain 209 and the coupler 310. The pressure vessel 401 may prevent drilling mud or other debris from contacting the sensor 308. The coupler 310 comprises a signal element 402 disposed on the geartrain side 311 of the coupler 310. In the present embodiment the signal element 402 comprises a generally disc-shaped geometry as well as a plurality of protrusions 403 disposed generally along a perimeter of the element 402. Each protrusion 403 comprises a ferromagnetic material. In the present embodiment the signal element 402 is mechanically coupled to the jack element 201 via the coupler 310 and the driving shaft 309.

FIG. 4 also discloses a position feedback sensor 202 that is adapted to detect the presence of a ferromagnetic protrusion 403. In some embodiments the sensor 202 may be adapted to detect the absence of a ferromagnetic protrusion 403. In the current embodiment the position feedback sensor 202 comprises at least one hall-effect sensor. Hall-effect sensors are known to detect the presence of ferromagnetic material in close proximity to the sensor by applying a magnetic flux to a conductor that is also carrying an electrical current. It is believed that applying the magnetic flux in a direction perpendicular to the direction of travel of the electrical current causes an electrical potential difference across the conductor. This electrical potential difference can be detected and thereby signal the close proximity of the ferromagnetic material to the hall-effect sensor. In some embodiments close proximity may be defined as within 6 mm. Close proximity may alternatively be defined as within 2.8 mm. Other embodiments of hall-effect sensors may also be consistent with the present invention. Additionally, in some embodiments the position feedback sensor 202 may comprise one or more hall-effect sensor, optical encoder, magnet, mechanical switch, rotary switch, resolver, or combinations thereof.

By counting the number of protrusions that pass by the sensor 202 in a given amount of time the differential velocity of the signal element 402 may be detected. The velocity of the signal element 402 may correspond directly to the velocity of the jack element 201 in a fixed ratio, thereby allowing the velocity of the jack element 201 to be determined. Preferably, the velocity of the driving shaft 309 and the signal element 204 may be between 60 and 160 rotations per minute (rpm).

In some embodiments the position feedback sensor 202 may be powered by a downhole source, such as a battery or generator. In other embodiments the sensor 202 may receive electrical power originating from the surface. The position feedback sensor 202 may be in electrical communication with a downhole network. The downhole network may transmit a signal from the sensor 202 to the computational board 208, thereby allowing the computation board to react to the signal by altering or maintaining some characteristic of the drilling operation.

In some embodiments a single position feedback sensor 202 may comprise a plurality of hall-effect sensors. In an embodiment of a position feedback sensor 202 comprising three hall-effect sensors, the position feedback sensor 202 may be able to determine the direction in which a signal element 402 is rotating by monitoring which hall-effect sensor first detects a given ferromagnetic protrusion 403. An example of such a position feedback sensor 202 is the Differential Speed and Direction Sensor model AT5651LSH made by Allegro MicroSystems, Inc., of Worcester, Mass. An example of a position feedback sensor 202 comprising one hall-effect sensor is the Unipolar Hall-Effect Switch model A1145LUA-T, also made by Allegro MicroSystems, Inc.

Figure 5:
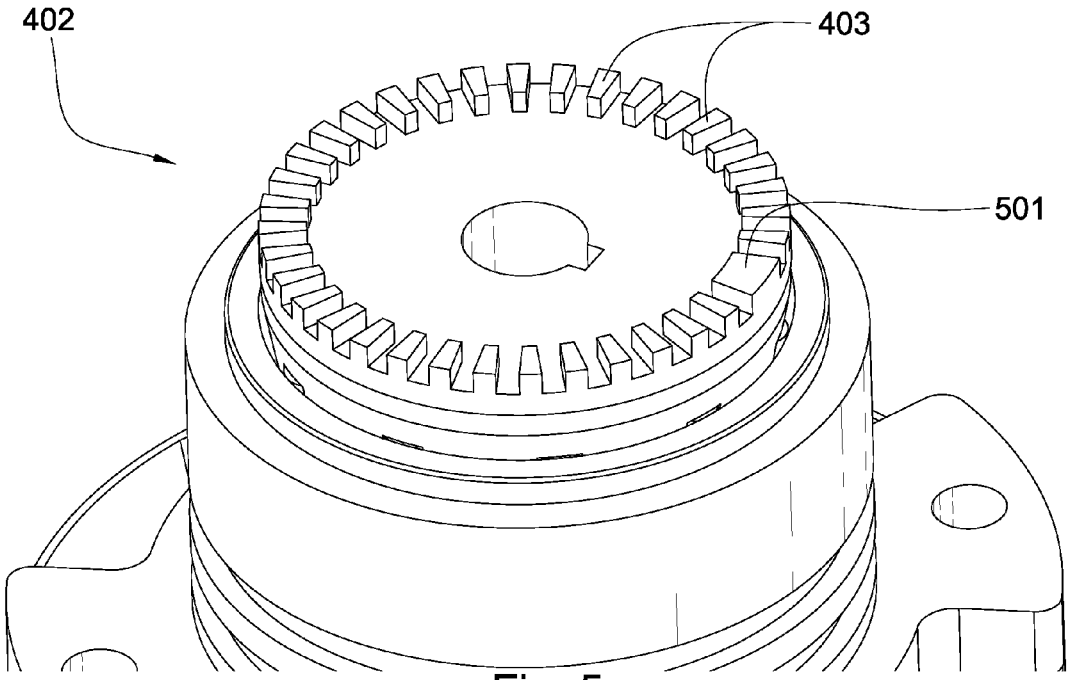
FIG. 5 is a perspective diagram of an embodiment of a portion of a jack assembly.

Referring now to FIGS. 5-8, various embodiments of signal elements 402 are disclosed. FIG. 5 discloses a perspective view of the embodiment of a signal element 402 and comprising a reference point 501. In FIG. 5 the reference point 501 is a protrusion 403 that is larger than the majority of the protrusions 403. This is believed to create a longer signal from the position feedback sensor 202. Having a detectable reference point 501 built into the signal element 402 is believed to allow for corrections to be made on velocity and position calculations should one or more protrusion 403 fail to activate the position feedback sensor 202. Furthermore, by counting how many protrusions 403 have been detected past the reference point 501 in a given direction, the orientation of the reference point 501 in relation to the sensor 202 may be determined. In some embodiments the reference point 501 may be a plurality of closely spaced elements that are detectable by the sensor 202, or an extended absence of detectable signal elements. In embodiments where the reference point 501 maintains a fixed orientation with the jack element 201, the orientation of the jack element 201 with respect to the sensor 202 may be determined. In some embodiments the orientation of the jack element 201 with respect to the sensor 202 may correspond to the jack element's 201 orientation with respect to the center of the planet, the surface of the ground, to some heavenly body, satellite, or to some other frame of reference important to drilling operations.

Figure 6:
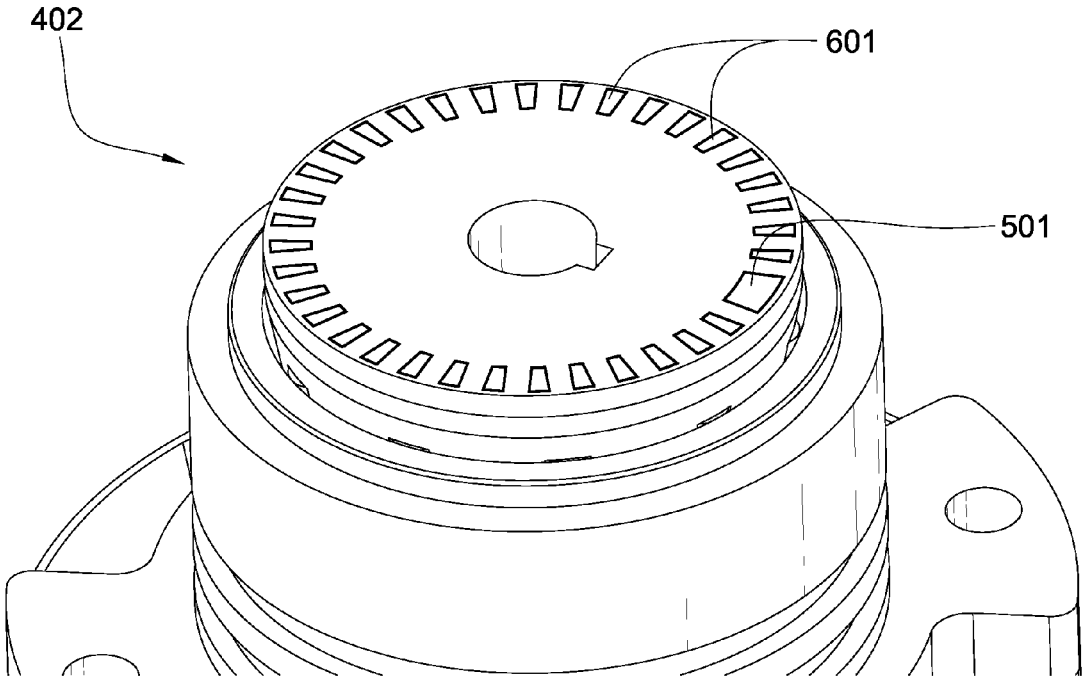
FIG. 6 is a perspective diagram of another embodiment of a portion of a jack assembly.

Referring now to FIG. 6, another embodiment of a signal element 402 is disclosed comprising a plurality of inserts 601 disposed along an outer perimeter of the signal element 402. The inserts 601 may comprise a characteristic that differs from the rest of the signal element 402 in density, geometry, length, chemical composition, magnetism, conductivity, optical reactivity, or combinations thereof. Sensor 202 may be adapted to detect a change in these characteristics on the signal element 402. In some embodiments, the inserts 601 may differ from each other in a detectable characteristic so that the absolute orientation of signal element 402 can be determined by detecting any given insert 601.

Figure 7:
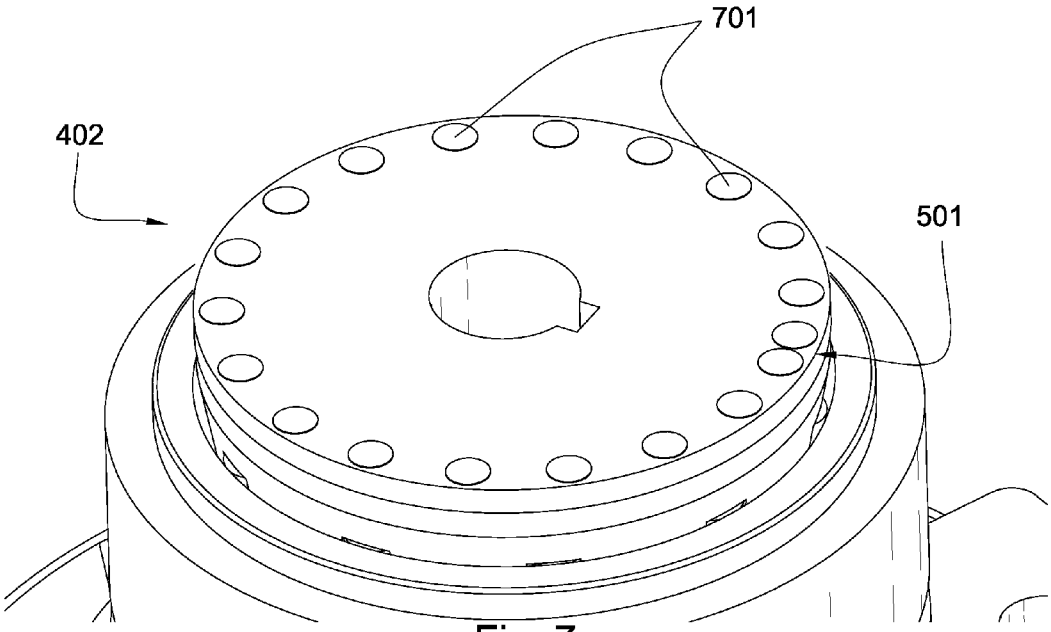
FIG. 7 is a perspective diagram of another embodiment of a portion of a jack assembly.

FIG. 7 discloses an embodiment of a signal element 402 comprising a plurality of coated regions 701. The coated regions 701 may affect a change in the characteristics of the signal element 402 perceived by sensor 202. The characteristic may include those noted above in the description of FIG. 6.

Figure 8:
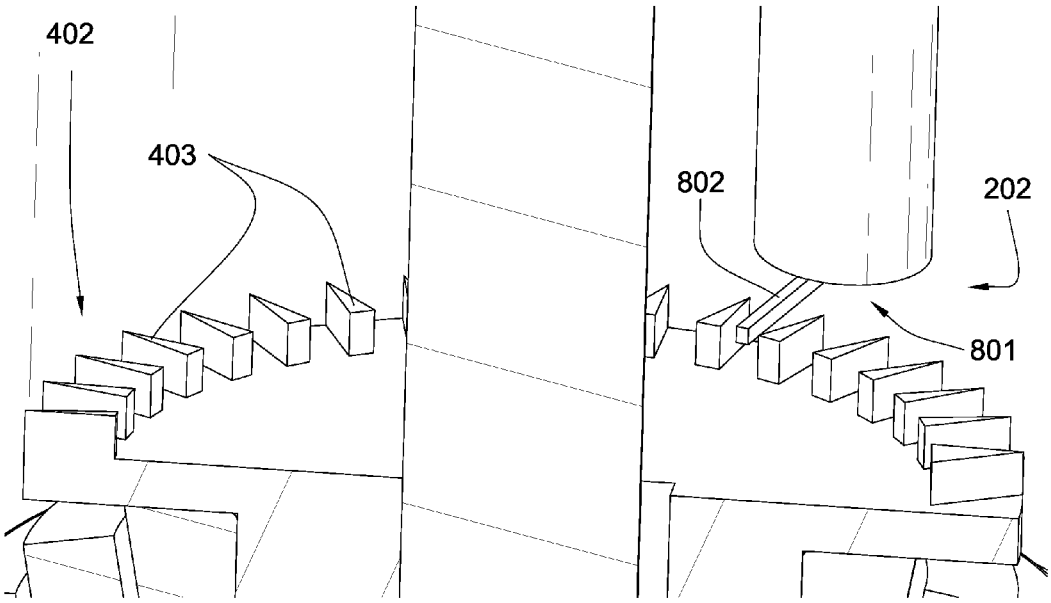
FIG. 8 is a cross-sectional diagram of another embodiment of a portion of a jack assembly.

FIG. 8 discloses an embodiment of a sensor 202 comprising a mechanical switch 801. The mechanical switch 801 is disposed proximate the signal element 402 and is rotateably isolated from the signal element 402. In the present embodiment the signal element 402 is adapted to rotate about a central axis. The signal element 402 comprises a plurality of protrusions 403 that are disposed along the outer perimeter of the signal element 402. The mechanical switch 801 may comprise an arm 802. When the arm 802 contacts a protrusion 403, an increase of strain in the arm 802 may result thereby inducing a signal. The arm 802 may be in communication with a strain gauge or it may be a smart material such as a piezoelectric or magnetostrictive material which may generate a signal under such a strain. In some embodiments, the protrusions 403 and arm 802 may complete an electric circuit when in contact with one another. It is believed that the arm 802 should comprise a certain degree of flexibility allowing the arm 802 to contact the protrusion 403 while allowing the arm 802 to slide past the protrusion 403 as the signal element 402 continues to rotate. In some embodiments the arm 802 may rotate about a central axis, or both the arm 802 and the signal element 402 may rotate about a central axis. Although specific sensors 202 and signal elements 402 have been disclosed, other sensors 202, signal elements 402, and detectable signal element characteristics may be compatible with the present invention.

Figure 9:
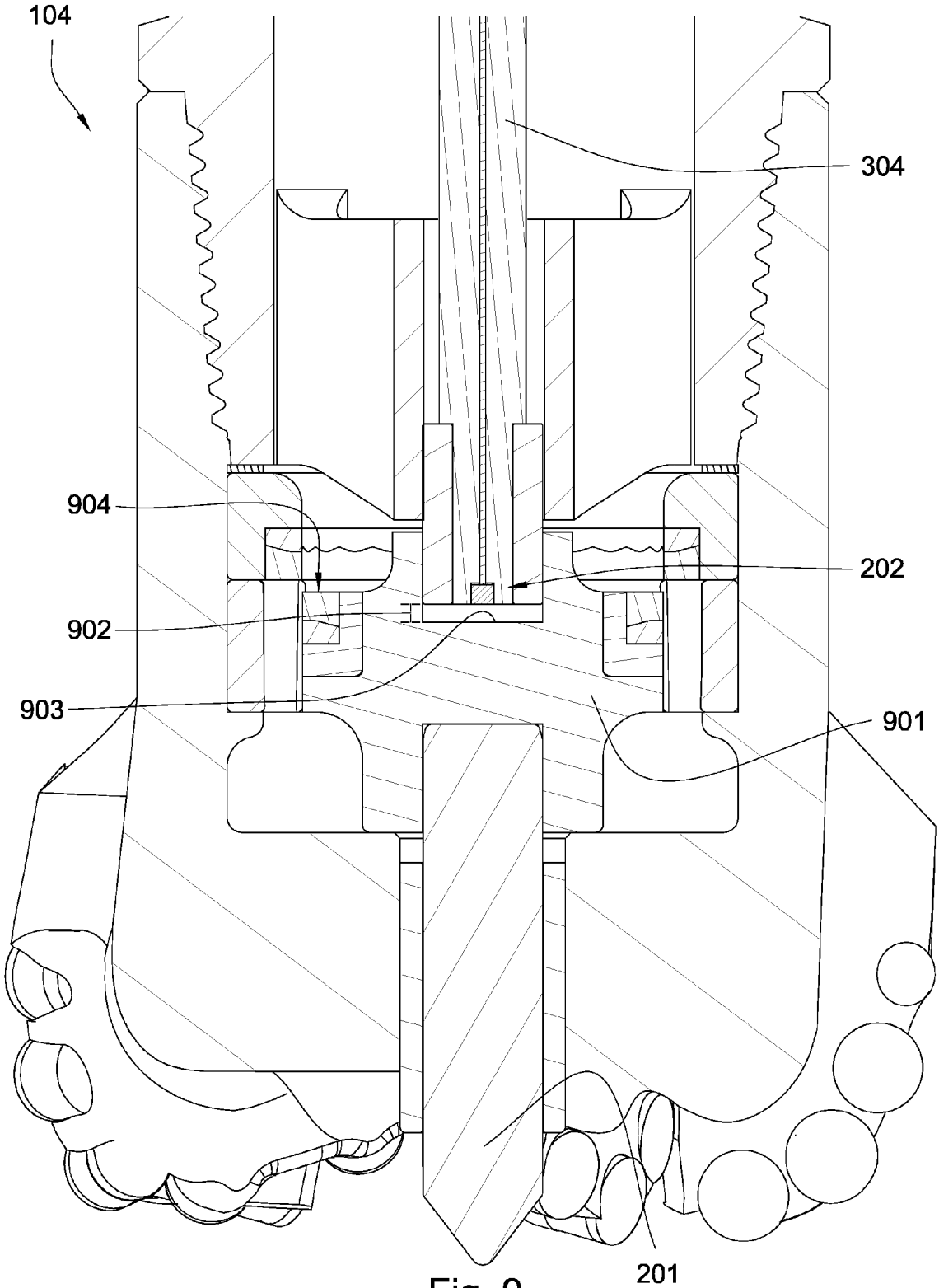
FIG. 9 is a cross sectional diagram of another embodiment of a jack assembly.

Referring now to FIG. 9, a position feedback sensor 202 is disposed proximate the jack element 201. Specifically the sensor 202 is disposed within an end of the driving shaft 309 that is proximate the jack element 201. A support element 901 is disposed intermediate the jack element 201 and the driving shaft 309. The support element 901 may be rotationally fixed to the jack element 201 and to the driving shaft 309. The support element 901 may be adapted to oscillate back and forth in relation to the driving shaft 309. This oscillation may be driven in one direction by the force of drilling mud impacting the support element 901, and in the other direction by the impact of the jack element 201 with the formation 105. When the jack element 201 is fully extended drilling mud release valves 904 may be opened, thereby allowing the force of the jack element impacting the formation 105 to drive the jack element 201 to a retracted position, which may automatically close the valves 904.

In the present embodiment the position feedback sensor 202 is a hall-effect sensor. In some embodiments the jack element 201 or the support element 901 may comprise a ferromagnetic material. A gap 902 between the sensor 202 and an inner surface 903 of the support element 901 may be greater than 6 mm when the jack element 201 is fully extended into the formation 105. The gap 902 may be less than 2.8 mm when the jack element is fully retracted from the formation 105. When the gap 902 is less than 2.8 mm the sensor 202 may signal the computational board 208. The amount of time between signals may indicate an oscillation frequency of the jack element 201. It is believed that the jack oscillation frequency may be indicative of a formation characteristic, such as formation hardness.

Figure 10:
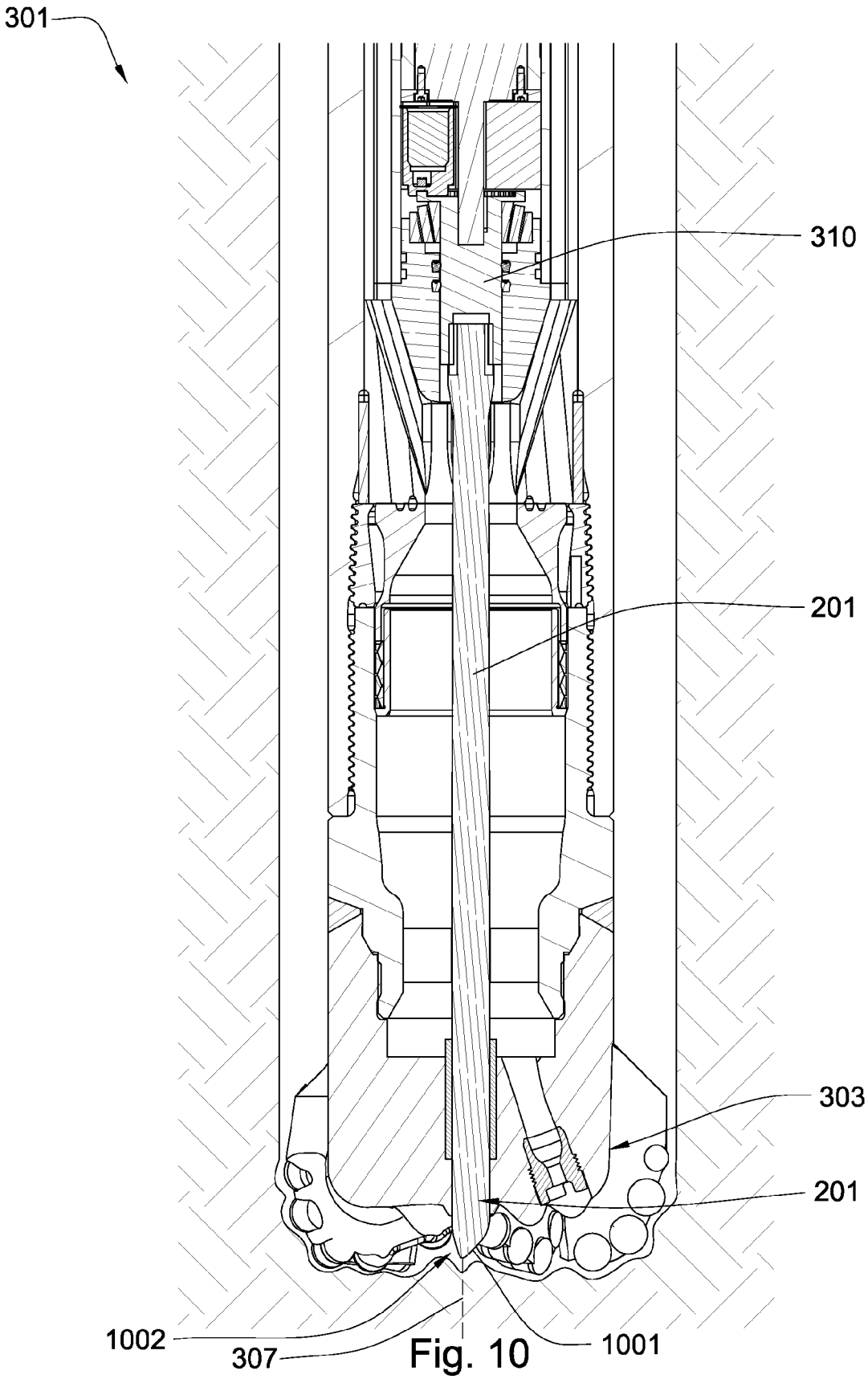
FIG. 10 is a cross sectional diagram of another embodiment of a jack assembly.

FIG. 10 discloses a jack element 201 that extends from the working face 303 all the way to the coupler 310. FIG. 10 discloses the long jack element 201 in conjunction with the primary deflecting surface 1001 located on a distal end 1002 of the jack element 201. The jack element 201 disclosed in FIG. 10 may be adapted to rotate about central axis 301, and may or may not be adapted to oscillate with respect to the drill bit 104.

Figure 11:
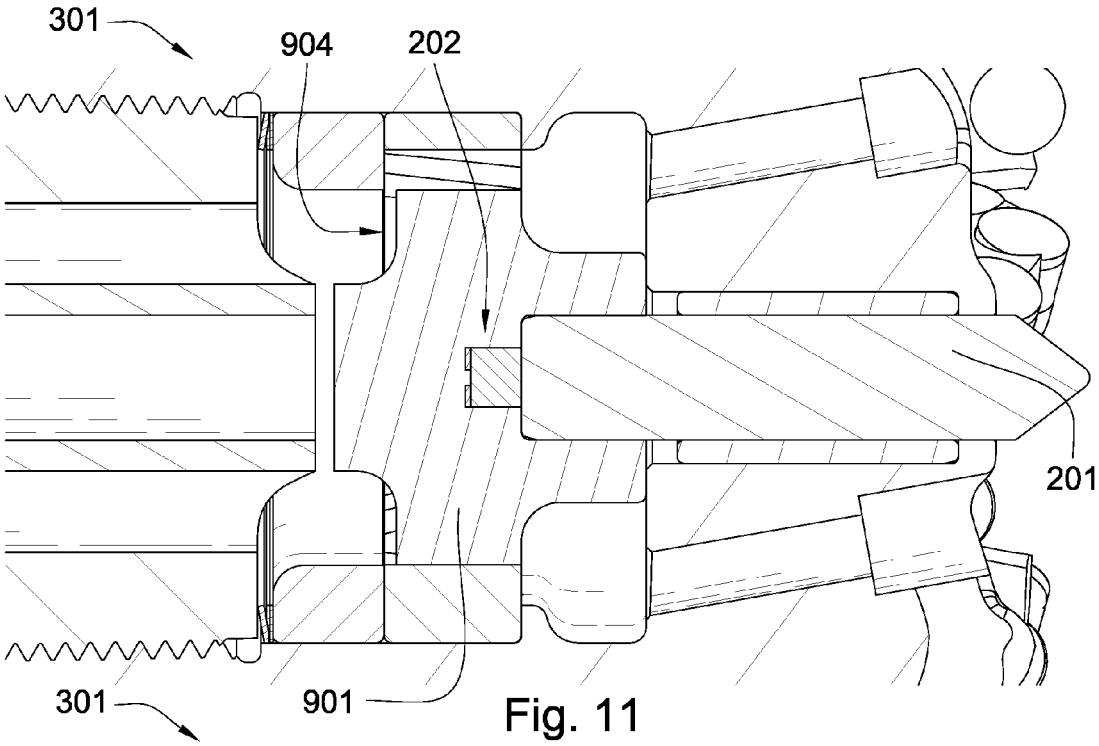
FIG. 11 is a cross-sectional diagram of another embodiment of a jack assembly.
Figure 12:
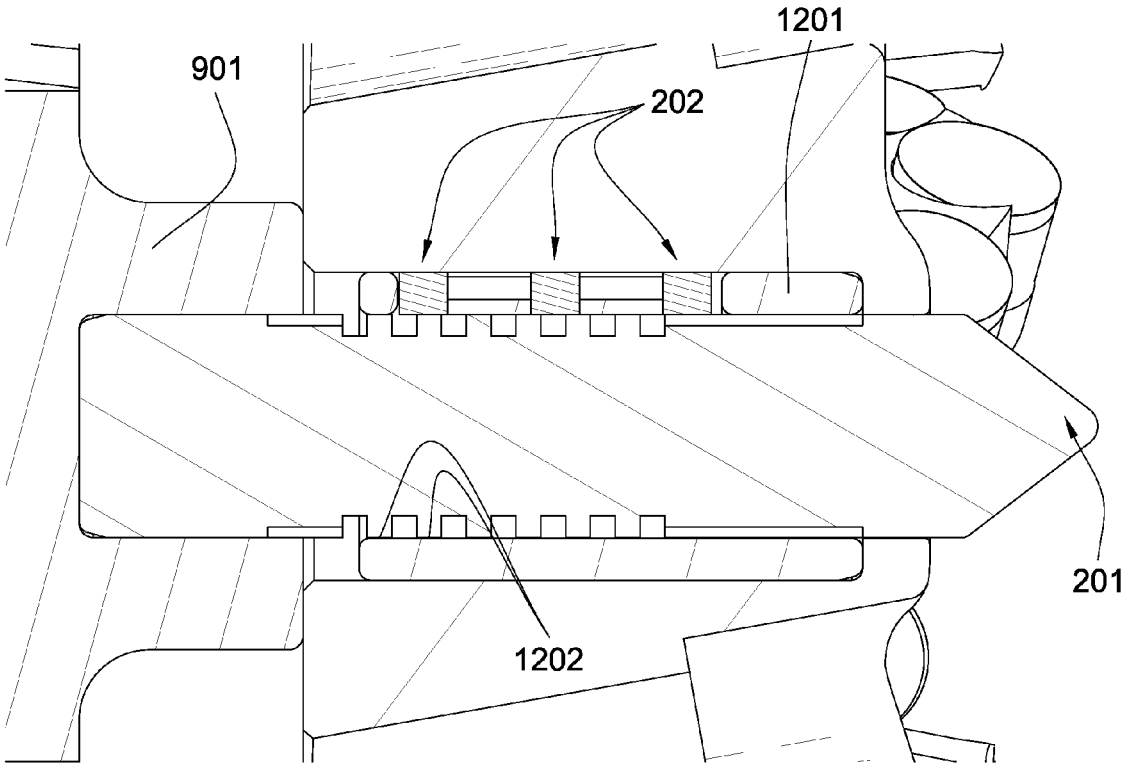
FIG. 12 is a cross-sectional diagram of another embodiment of a jack assembly.

FIGS. 11 and 12 disclose alternate embodiments of support element 901 wherein support element 901 is translationally independent of any driving shaft 309 disposed within the jack assembly 301. FIGS. 11 and 12 also disclose embodiments of position feedback sensors 202 disposed proximate the jack element 201. In FIG. 11 the position feedback sensor 202 is disposed intermediate the support element 901 and the jack element 201 and is rotationally coupled with respect to the jack element 202. In the current embodiment position feedback sensor 202 may comprise an accelerometer.

Referring now to FIG. 12, a plurality of position feedback sensors 202 are disposed in a bushing 1201 proximate the jack element 201. The jack element 201 may comprise a plurality of recesses 1202 separated by a ferromagnetic material and disposed proximate the sensors 202. The sensors 202 may comprise hall-effect sensors that may sense the presence or absence of the recesses 1202. It is believed that this embodiment may allow for not only the frequency of jack oscillation to be detected, but also whether the jack element 201 is fully retracted or fully extended.

Figure 13:
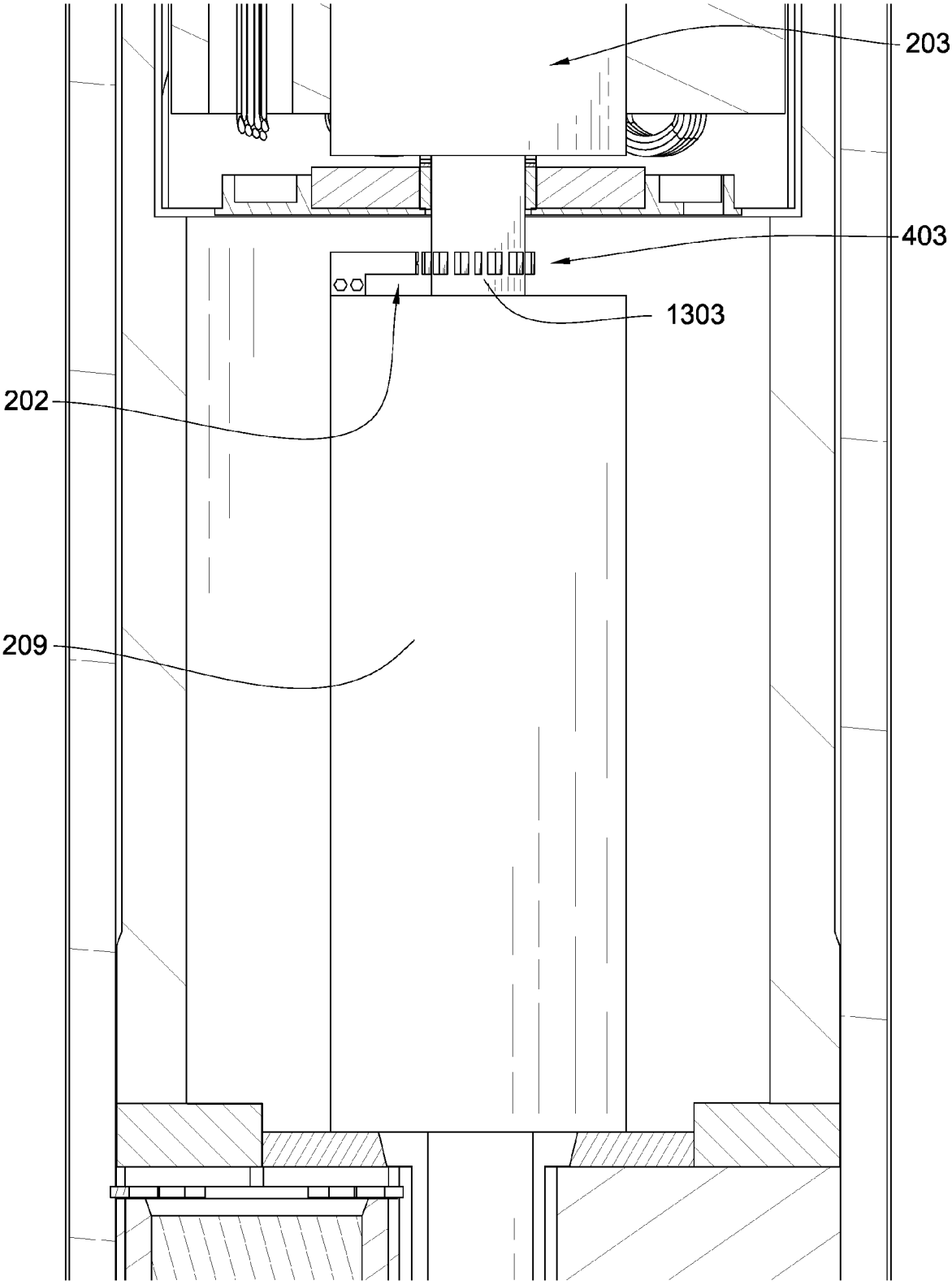
FIG. 13 is a cross-sectional diagram of an embodiment of a position feedback sensor disposed in an embodiment of a geartrain.

Referring now to FIG. 13, an embodiment is disclosed in which the position feedback sensor 202 is disposed proximate the geartrain 209. In the present embodiment the sensor 202 is disposed proximate an extension 1303 of the motor 203 that protrudes into the geartrain. The extension 1303 comprises protrusions 403 that may be recognized by the sensor 202, thereby indicating the velocity of rotation of extension 1303. The velocity of rotation of extension 1303 may directly correlate to the velocity of rotation of the jack element 201 in a ratio of 25:1. In some embodiments of the invention one or more sensor 202 may be disposed in other areas within the geartrain 209.

Figure 14:
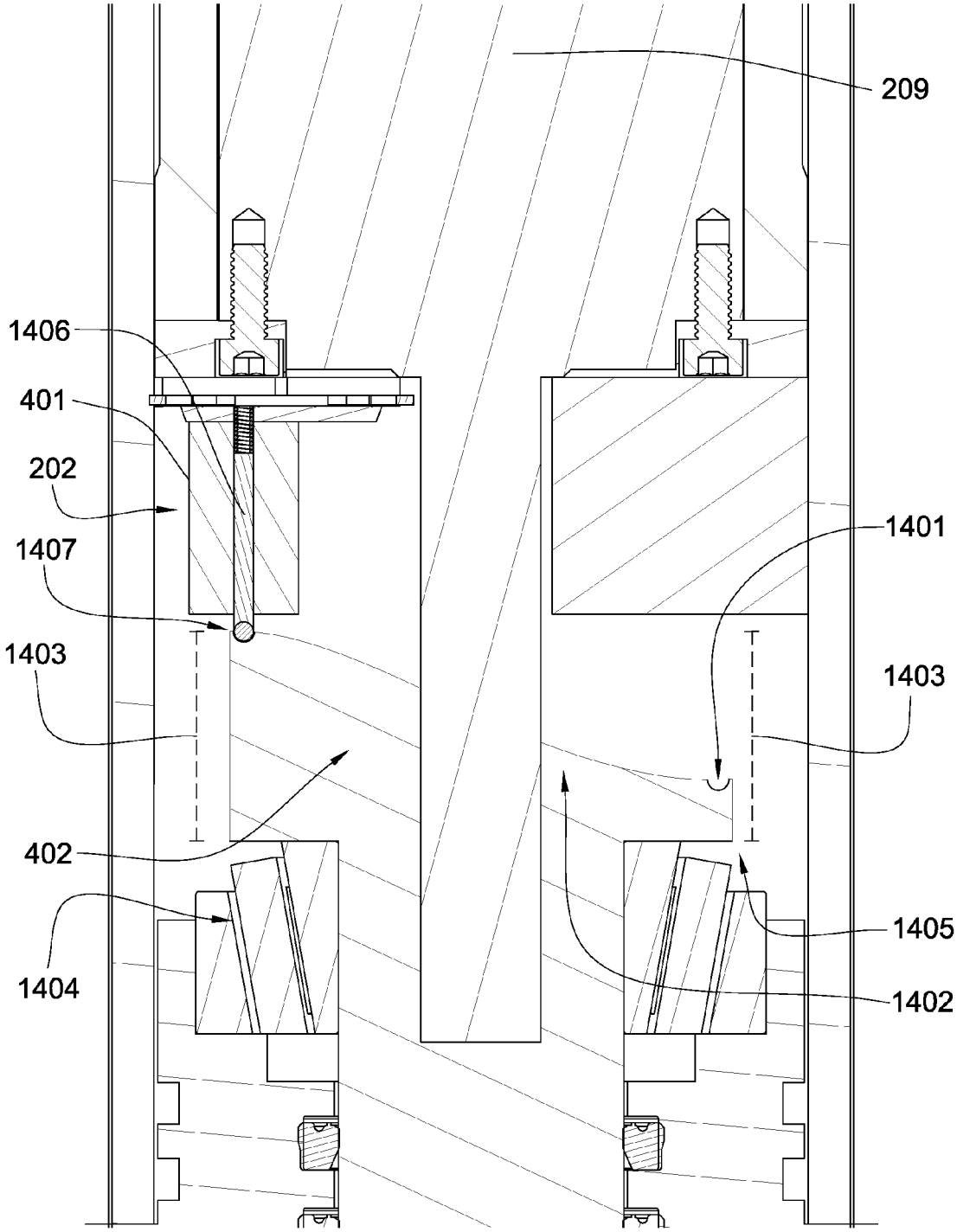
FIG. 14 is a cross-sectional diagram of another embodiment of a position feedback sensor and a signal element.

Referring now to FIG. 14, another embodiment of a signal element 402 is disclosed. FIG. 14 discloses a cross-sectional view of a signal element 402 connected to the geartrain 209 and disposed proximate an embodiment of a position feedback sensor 202. In this embodiment the signal element 402 comprises a generally circular base and a tapered profile 1402. The signal element 402 may comprise an element height 1403 that is longer at a first end 1404 than the height at a second end 1405. The position feedback sensor 202 may comprise a probe 1406 that retractably extends from the pressure vessel 401. In FIG. 14 the probe 1406 is spring loaded and the spring tension may be monitored to determine how far the probe is extended. In other embodiments the probe 1406 may comprise a compressed gas and a pressure sensing device (not shown). The probe 1406 may comprise a generally spherical tip 1407 that may be adapted to rotate about any axis that runs through a center of the spherical tip 1407. As the signal element 402 rotates about a central axis the probe 1406 may retract or extend depending on the height 1403 of the signal element 402 at that particular position. FIG. 14 also discloses a guide track 1401 disposed around a perimeter of the signal element 402. The spherical tip 1407 of the probe 1406 may fit into the guide track 1401 and may follow the guide track 1401 around the perimeter of the signal element 402.

Whereas the present invention has been described in particular relation to the drawings attached hereto, it should be understood that other and further modifications apart from those shown or suggested herein, may be made within the scope and spirit of the present invention.

What is claimed is:

1. A drill string comprising:

a drill bit with a body intermediate a shank and a working face, the working face comprising at least one cutting element;

a jack assembly disposed within the drill bit body and comprising a jack element disposed on a distal end of the assembly;

the jack element substantially protruding from the working face and being adapted to move with respect to the bit body; and at least one position feedback sensor disposed proximate the jack assembly and adapted to detect a position and/or orientation of the jack element with respect to the drill bit;

wherein the jack assembly comprises a driving shaft disposed intermediate a driving mechanism and the jack element;

wherein the jack assembly comprises a geartrain disposed intermediate the driving mechanism and the driving shaft; and wherein the at least one position feedback sensor is disposed within the geartrain.

2. The drill string of claim 1, wherein the at least one position feedback sensor is adapted to calculate a velocity or oscillation frequency of the jack element.

3. The drill string of claim 1, wherein the jack element is adapted to rotate about a central axis.

4. The drill string of claim 1, wherein the jack element is adapted to translate along a central axis.

5. The drill string of claim 1, wherein movement of the jack element is powered by a downhole motor.

6. The drill string of claim 1, wherein the at least one position feedback sensor is powered by a downhole power source.

7. The drill string of claim 1, wherein the at least one position feedback sensor is in electrical communication with a downhole network.

8. The drill string of claim 1, wherein the at least one position feedback sensor is part of a bottom hole assembly.

9. The drill string of claim 1, wherein the at least one position feedback sensor comprises a hall effect sensor, an optical encoder, a magnet, a mechanical switch, a rotary switch, a resolver, an accelerometer, or combinations thereof.

10. The drill string of claim 1, wherein the at least one position feedback sensor senses the position and/or orientation of the jack element by recognizing a characteristic of a signal element disposed proximate the sensor.

11. The drill string of claim 10, wherein the characteristic comprises a change in density, geometry, length, chemical composition, magnetism, conductivity, optical reactivity, surface coating composition, or combinations thereof.

12. The drill string of claim 10, wherein the signal element comprises a generally disc-shaped geometry, is disposed in the jack assembly, and is mechanically coupled to the jack element.

13. The drill string of claim 1, wherein the drill string comprises a plurality of position feedback sensors.

14. The drill string of claim 1, wherein the jack element comprises a distal deflecting surface having an angle relative to a central axis of 15 to 75 degrees.

15. The drill string of claim 1, wherein the drill string further comprises at least one electrical component selected from the group consisting of direction and inclination packages, generators, motors, computational boards, position feedback sensors, accelerometers, or combinations thereof.

16. The drill string of claim 15, wherein the at least one electrical component is rotationally fixed to the drill string

17. The drill string of claim 15, wherein the at least one electrical component is rotationally coupled with respect to the jack element.

* * * * *

UNITED STATES PATENT AND TRADEMARK OFFICE

CERTIFICATE OF CORRECTION

PATENT NO. : 7,721,826 B2
APPLICATION NO. : 11/851094
DATED : May 25, 2010
INVENTOR(S) : David R. Hall et al.

It is certified that error appears in the above-identified patent and that said Letters Patent is hereby corrected as shown below:

In the Claims

In column 10, claim 16, line 26, immediately after "fixed to the drill string" insert --.--.

Signed and Sealed this
Sixth Day of March, 2012

David J. Kappos
*Director of the United States Patent and Trademark Office*